US006854141B2

(12) United States Patent
Nagaoka et al.

(10) Patent No.: US 6,854,141 B2
(45) Date of Patent: Feb. 15, 2005

(54) LIFTING CONTROL METHOD FOR LYING FURNITURE SUCH AS A BED

(75) Inventors: Hiroshi Nagaoka, Tokyo (JP); Masao Horitani, Tokyo (JP); Satoru Inoue, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 0 days.

(21) Appl. No.: 10/389,962

(22) Filed: Mar. 18, 2003

(65) Prior Publication Data

US 2004/0016056 A1 Jan. 29, 2004

(30) Foreign Application Priority Data

Mar. 18, 2002 (JP) ..... 2002-075073

(51) Int. Cl.[7] ..... A47C 4/00
(52) U.S. Cl. ..... 5/618; 5/600
(58) Field of Search ..... 5/618, 600

(56) References Cited

U.S. PATENT DOCUMENTS 3,644,945 A * 2/1972 Goodman et al. ..... 5/618
3,965,500 A * 6/1976 Stein, Jr. ..... 5/618
4,395,786 A * 8/1983 Casey et al. ..... 5/618
4,425,673 A * 1/1984 Werner ..... 5/618
4,660,236 A * 4/1987 Peterson ..... 5/618
5,205,004 A * 4/1993 Hayes et al. ..... 5/618
5,544,375 A * 8/1996 Urness et al. ..... 5/618
6,000,077 A * 12/1999 Cyr ..... 5/618
6,230,346 B1 * 5/2001 Branson et al. ..... 5/618

* cited by examiner

*Primary Examiner*—Frederick L. Lagman
(74) *Attorney, Agent, or Firm*—Townsend & Banta

(57) ABSTRACT

This invention relates to a method of controlling the lifting of bottom sections of lying furniture such as a bed. It is a method of controlling the lifting of bottom sections of lying furniture such as a bed that has a back bottom section for lifting the back portion of a lying person and a knee bottom section for lifting his/her knee portion, in which the respective bottom sections can be lifted by the lifting mechanisms respectively provided for them, characterized in that in the case where all the bottom sections are lowered to lie flat from a state where the back bottom section is kept inclined after having been pivotally rotated and lifted, at first the lifting of the knee bottom section is started, and at a time instant adequately later than the lifting start time instant, the lowering of the back bottom section is started; thereafter the lowering of the back bottom section is continued, while the knee bottom section is lifted to the preset highest position and then is lowered to reach its lower limit position of lying flat at a time instant adequately later than the time instant when the back bottom section is lowered to its lower limit position of lying flat.

13 Claims, 3 Drawing Sheets

LIFTING CONTROL METHOD FOR LYING FURNITURE SUCH AS A BED

FIELD OF THE INVENTION

The present invention generally relates to an interlocked lifting control method for lying furniture such as a bed (hospital bed, ICU bed, long term care bed, etc.) or a stretcher. In more detail, it relates to an interlocked lifting control method for operating, especially lowering a back bottom section and a knee bottom section in an interlocked manner from a state where the back bottom section is inclined at the most largest inclination angle after having been lifted, for achieving the following object, on lying furniture having the back bottom section for lifting the back portion of a lying person and the knee bottom section for lifting his/her knee portion.

BACKGROUND OF THE INVENTION

Prior Art

Some of lying furniture such as beds and stretchers are respectively provided with a back bottom section for lifting the back portion of a lying person and a knee bottom section for lifting his/her knee portion, which can be respectively lifted by lifting mechanisms respectively provided for them.

Many examples of such lying furniture can be seen in U.S. Pat. Nos. 5,469,591, 5,448,789, 5,388,290, etc.

For example, the bed described in U.S. Pat. No. 5,469,591 has a back bottom section for lifting the back portion of a lying person, a knee bottom section for lifting his/her knee portion, and other bottom sections. On the undersides of the back bottom section and the knee bottom section, lifting arms each having a roller at the tip are installed pivotally rotatably, and the lifting arms can be driven and rotated by electric drive mechanisms such as motors.

In this constitution, the lifting arm of the back bottom section is pivotally rotated to let its roller lift the back bottom section in a pivotally rotating motion, for making it inclined, thereby lifting the back of the lying person, so that he/she can get up on the bed.

When the back bottom section is lifted and inclined like this, the lifting arm of the knee bottom section is pivotally rotated to let its roller lift the knee bottom section in a pivotally rotating motion, for making it inclined, thereby effectively preventing that the lying person slides forward if the back bottom section only is lifted.

That is, in the case where the person lying on the bed is lifted at his/her back, to get up, if the back bottom section is lifted, his/her body gradually slides forward since he/she is pressed forward at his/her back by the back bottom section. As a result, the point at which his/her body can be easily bent shifts from the pivot of the back bottom section. So, a force for bending the lumbar vertebra portion unlikely to be bent is applied from the back bottom section, to press the lumber vertebra portion and the abdominal region of the lying person, making him/her feel displeasure.

Therefore, if the knee bottom section is lifted when the back bottom section is lifted, the body portion located above the inclined knee bottom section, i.e., femoral regions can receive the force applied from the back bottom section to press the lying person forward. As a result, the body sliding and displeasure feeling caused when his/her back only is lifted by means of the back bottom section can be prevented.

The conventional methods for also lifting the knee bottom section when lifting the back bottom section include, for example, the following.

a. As a first example, the drive mechanisms for lifting the back bottom section and the knee bottom section are operated respectively independently, and the lying person per se or a nurse simultaneously or alternately turns on and off the respective drive mechanisms, using, for example, remote control switches, to lift the back bottom section and the knee bottom section respectively to desired positions.

b. As a second example, a common motor or the like is used to drive the drive mechanisms of the back bottom section and the knee bottom section using an interlocking mechanism such as a link mechanism, so that the drive mechanisms of the back bottom section and the knee bottom section can be actuated in a mechanically interlocked manner, to lift the back bottom section and the knee bottom section to predetermined positions.

Problems of the Prior Art

However, these conventional methods have the following problems.

A. In the method a, the lying person or a nurse must simultaneously or alternately operate the respective drive mechanisms of the back bottom section and the knee bottom section. This operation is very complicated and troublesome, and the operator must be accustomed to it. Furthermore, it is difficult to always reproduce the optimum lifting states respectively for the back bottom section and the knee bottom section.

B. In the method b, since an interlocking mechanism is used, the lifting states of the back bottom section and the knee bottom section achieved in an interlocked manner are inevitably simple and cannot be adjusted or changed, and it is difficult to efficiently prevent both the body sliding and the displeasure feeling such as pressure feeling. Moreover, the back bottom section and the knee bottom section cannot be operated respectively independently.

Furthermore, though the prior art takes a measure for preventing the forward body sliding and the pressure feeling of the lying person caused when the back bottom section is lifted as described above, the prior art does not take the measure for preventing the body sliding of the lying person caused when the back bottom section is lowered. So, a caregiver must return the lying person caused to slide on the bed, to the original position, after all the bottom sections have been lowered to lie flat.

SUMMARY OF THE INVENTION

This invention has been achieved in view of the above-mentioned problems. It provides lying furniture such as a bed that has a back bottom section for lifting the back portion of a lying person and a knee bottom section for lifting his/her knee portion, in which the respective bottom sections can be lifted by the lifting mechanisms respectively provided for them, wherein when the back bottom section is pivotally rotated and lifted to be kept inclined from a flat state where all the bottom sections are kept down to lie flat, both the body sliding and the displeasure feeling such as pressure feeling can of course be efficiently prevented. In addition, also when all the bottom sections are lowered to lie flat from a state where the back bottom section is kept inclined after having been pivotally rotated and lifted, the body sliding can be efficiently prevented.

At first, the first subject matter of this invention described in claim 1 proposes a method of controlling the lifting of bottom sections of lying furniture such as a bed that has a back bottom section for lifting the back portion of a lying person and a knee bottom section for lifting his/her knee portion, in which the respective bottom sections can be lifted by the lifting mechanisms respectively provided for them, characterized in that in the case where all the bottom sections are lowered to lie flat from a state where the back bottom section is kept inclined after having been pivotally rotated and lifted, at first the lifting of the knee bottom section is started, and at a time instant adequately later than the lifting start time instant, the lowering of the back bottom section is started; thereafter the lowering of the back bottom section is continued, while the knee bottom section is lifted to the preset highest position and then is lowered to reach its lower limit position of lying flat at a time instant adequately later than the time instant when the back bottom section is lowered to its lower limit position of lying flat.

In this method, while the back bottom section is pivotally lowered, the knee bottom section stays at a lifted position. So, the knee bottom section supports the position of the waist of the lying person since the knee bottom section stays at a lifted position. Therefore, even if the back bottom section is lowered in this state, it can be prevented that the lying person slides forward even if the back bottom section is lowered.

If the lifting of the knee bottom section is continued without control when the back bottom section is lowered, the knee portion of the lying person is lifted to higher than necessary, to let him/her feel displeasure. Furthermore, since the angle formed between the back bottom section and the knee bottom section becomes smaller, the abdominal region of the lying person is bent as a result, to let him/her feel a pressure. However, according to the first subject matter of this invention, the lifting of the knee bottom section is not continued without control, but is limited to a preset high position. So, it does not happen that the angle formed between the back bottom section and the knee bottom section becomes smaller than a certain angle. Therefore, it can be prevented that the knee portion of the lying person is lifted to a position higher than necessary to gradually bend his/her abdominal region, letting him/her feel a pressure.

The second subject matter of this invention described in claim 2 proposes that the time instant when the lowering of the back bottom section is started later than the time instant when the lifting of the knee bottom section is started, and/or the time instant when the knee bottom section reaches the highest position is judged in reference to the time elapsed after the time instant when the lifting of the knee bottom section is started. The third subject matter of this invention described in claim 3 proposes a constitution, in which the elapsed time can be preset.

In the case where the capacities of the drive sources such as motors for actuating the lifting mechanisms of the back bottom section and the knee bottom section are sufficiently larger than the forces necessary for lifting the back bottom section and the knee bottom section on which the load of the lying person acts, or in the case where the load is constant, there is a constant correlation between the time elapsed after the time instant of actuating a lifting mechanism and the position of the corresponding lifted bottom section. So, the elapsed time easy to control can be used to carry out the above-mentioned action control in response to the lifted position or lowered position of each bottom section.

The fourth subject matter of this invention described in claim 4 proposes that the time instant when the lowering of the back bottom section is started later than the time instant when the lifting of the knee bottom section is started is judged by a position detecting means of the knee bottom section, and the fifth subject matter of this invention described in claim 5 proposes that the highest position of the knee bottom section can be preset.

DETAILED DESCRIPTION OF PREFERRED EMBODIMENTS

Preferred embodiments of this invention are described below in more detail in reference to the attached drawings.

FIGS. 1 to 6 are side views showing the entire form of a bottom in respective phases in the lifting action, in the case where the method of controlling the lifting of bottom sections of this invention is applied to a bed.

The illustrated bed is composed of a back bottom section 1*a* for lifting the back portion of a lying person, a knee bottom section 1*b* for lifting his/her knee portion, and a leg bottom section 1*c* corresponding to his/her leg portion. The back bottom section 1*a*, the knee bottom section 1*b* and the leg bottom section 1*c* are connected with each other to form a bendable bottom corresponding to the whole body.

In the bed of this example, the bottom corresponding to the whole body is composed of the above-mentioned divided three bottom sections 1*a*, 1*b* and 1*c* connected with each other. However, the bottom can also be divided into four portions, or as described, for example, in the aforesaid U.S. Pat. Nos. 5,469,591, 5,448,789 and 5,388,290, many members can be connected with each other to form a bendable bottom. Anyway the bed to which this invention is applied is only required to have a back bottom section for lifting the back portion of the lying person and a knee bottom section for lifting his/her knee portion.

Furthermore, the lifting mechanisms for lifting the back bottom section 1*a* and the knee bottom 1*b* portion can be the mechanisms as described, for example, in the aforesaid U.S. Pat. Nos. 5,469,591, 5,448,789 and 5,388,290. That is, a lifting arm having a roller at the tip, which can be pivotally rotated by an electric drive mechanism such as a motor, can be installed to let the roller lift and support each bottom section, or a linear motion member with a rotary motion-linear motion conversion mechanism consisting of a threaded shaft and a female screw engaged with it can be connected with an arm installed on the underside of each bottom section.

The lifting mechanisms for lifting the back bottom section 1*a* and the knee bottom section 1*b* are so constituted that they can be of course controlled in an interlocked manner as described later, or in addition, can also be controlled to actuate the respective bottom sections individually as required.

Figure 1:
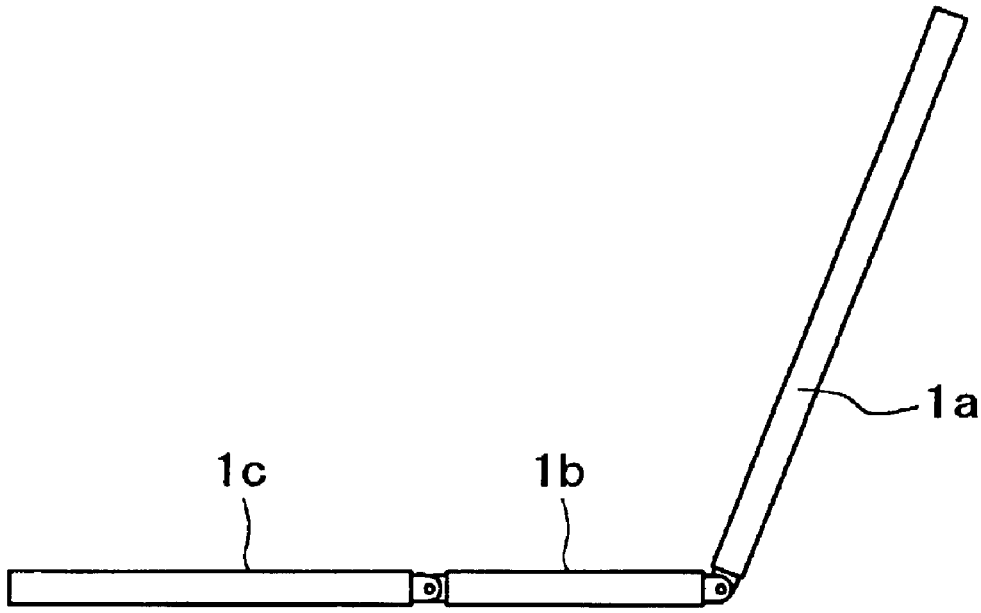
FIG. 1 is a side view showing the entire form of a bottom in one phase in the lifting action, i.e., when the back bottom section is lifted to the highest position, in the case where the method of controlling the lifting of bottom sections of this invention is applied to a bed.

In the above-mentioned constitution, FIG. 1 shows a state where the back bottom section 1*a* is lifted most with the largest inclination angle. In this state, the lying person such as a patient gets up with his/her back supported by the back bottom section 1*a*.

For lowering all the bottom sections 1*a*, 1*b* and 1*c* to lie flat in an ordinary position from this state, a control switch issues an operation command to the effect that the bottom sections should be lowered in an interlocked manner, to a controller of lifting mechanisms.

Figure 2:
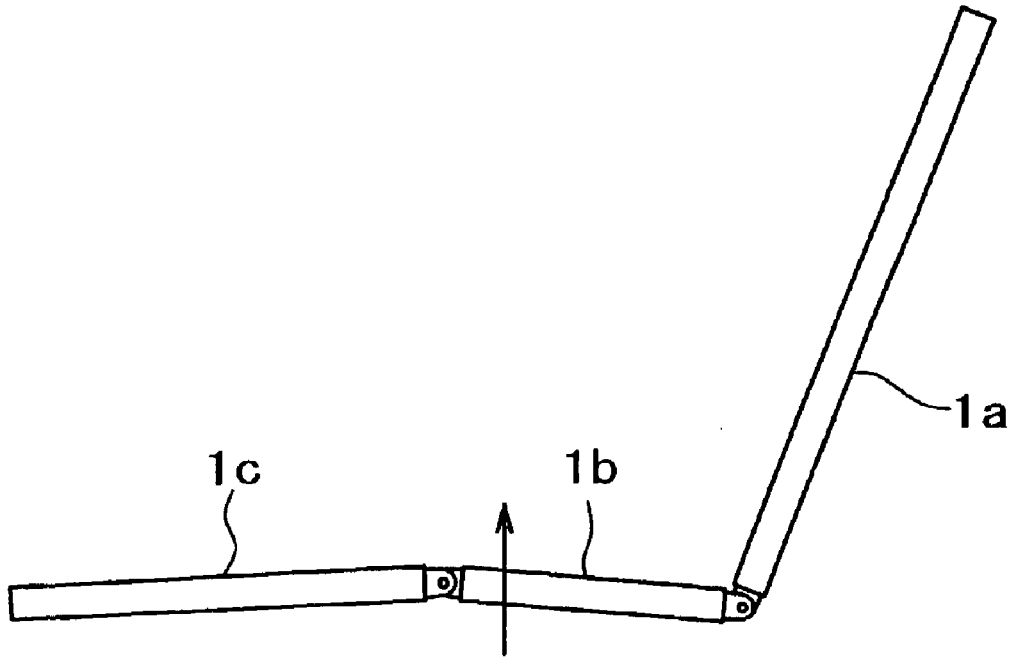
FIG. 2 is a side view showing the entire form of a bottom in another phase in the lifting action, in the case where the method of controlling the lifting of bottom sections of this invention is applied to a bed.

Receiving this command, the controller actuates, at first, the lifting mechanism of the knee bottom section 1*b* only, to lift the knee bottom section 1*b* only as shown in FIG. 2.

Figure 3:
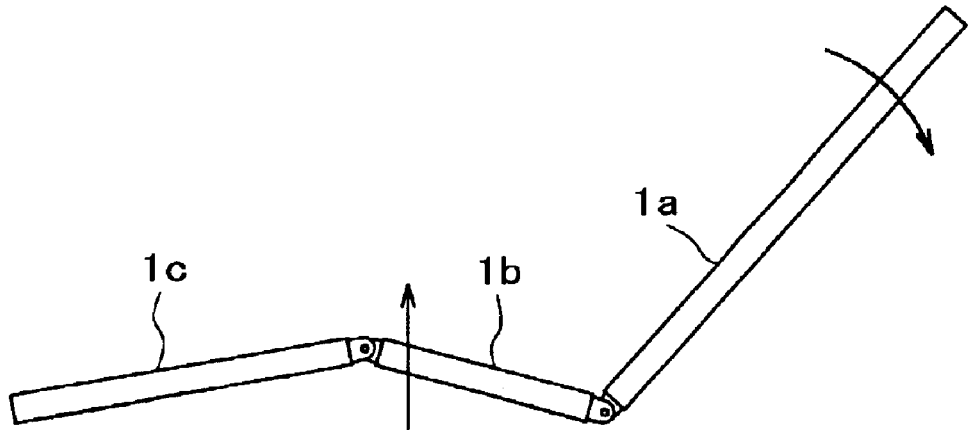
FIG. 3 is a side view showing the entire form of a bottom in a further other phase in the lifting action, in the case where the method of controlling the lifting of bottom sections of this invention is applied to a bed.

Then, the controller starts lowering the back bottom section 1*a* at a time instant adequately later than the time instant when the lifting of the knee bottom section 1*b* is started, in response to said command. Thereafter, as shown in FIG. 3, the knee bottom section 1*b* is further lifted, while the back bottom section 1*a* is lowered.

In this invention, as described above, for lowering all the bottom sections to let them lie flat from a state where the back bottom section 1*a* is inclined at the largest angle after having been pivotally rotated and lifted, at first the lifting of the knee bottom section 1*b* is started, and at a time instant adequately later than the lifting start time instant, the back bottom section 1*a* is lowered. Therefore, at the time instant when the descending back bottom section 1*b* begins to give a sliding force to the waist of the lying person, the knee bottom section 1*b* is already adequately lifted. So, the lifted knee bottom section 1*b* supports the position of the waist of the lying person, to prevent that the lying person slides forward.

In this case, if the time instant when the lowering of the back bottom section 1*b* is started later than the time instant when the lifting of the knee bottom section 1*b* is started is judged in reference to the time elapsed after the time instant when the lifting of the knee bottom section 1*b* is started, the control is easy.

The time instant when the lowering of the back bottom section 1*a* is started can be a time instant before the knee bottom section 1*b* reaches the highest position, or the time instant when the knee bottom section 1*b* reaches the highest position.

In the former method, since the knee bottom section 1*b* does not reach the highest position at the time instant when the back bottom section 1*a* is inclined at the largest angle, the angle formed between the back bottom section 1*a* and the knee bottom section 1*b* is larger than that achieved by the latter method if the highest position of the knee bottom section 1*b* is set at the same level in both the methods. Therefore, it can be prevented that the gradually narrowed angle gradually bends the abdominal region of the lying person, letting him/her feel a pressure.

Figure 4:
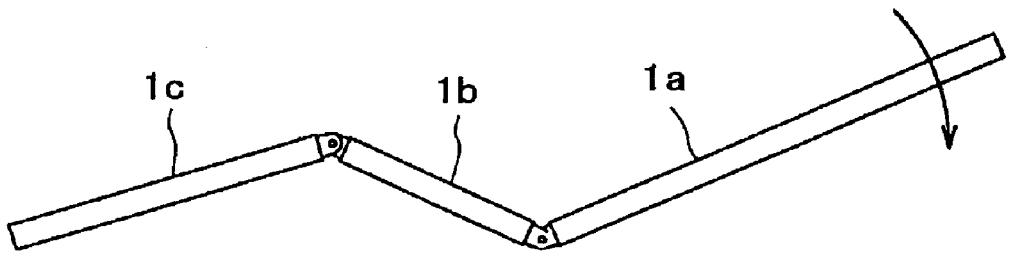
FIG. 4 is a side view showing the entire form of a bottom in a still further other phase in the lifting action, in the case where the method of controlling the lifting of bottom sections of this invention is applied to a bed.
Figure 5:
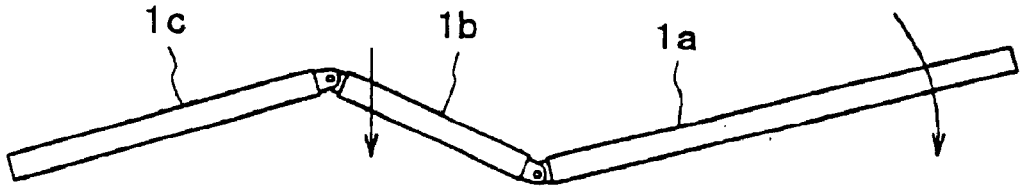
FIG. 5 is a side view showing the entire form of a bottom in a still further other phase in the lifting action, in the case where the method of controlling the lifting of bottom sections of this invention is applied to a bed.

If the above-mentioned action is continued to let the knee bottom section 1*b* reach the highest position, as shown in FIG. 4, the lifting of the knee bottom section 1*b* is stopped, while the lowering of the back bottom section 1*a* is further continued.

Then, the controller starts lowering the knee bottom section 1*b* staying at the highest position, while continuing the lowering of the back bottom section 1*a*. Therefore, at this time instant, both the back bottom section 1*a* and the knee bottom section 1*b* are lowered.

Figure 6:
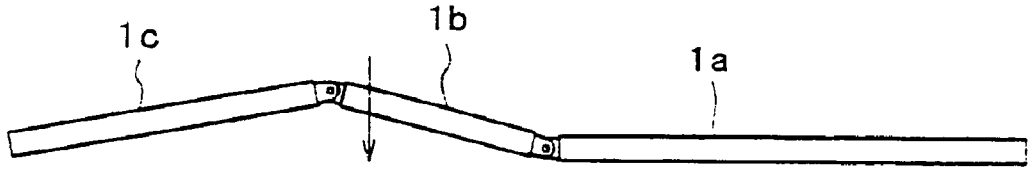
FIG. 6 is a side view showing the entire form of a bottom in a still further other phase in the lifting action, in the case where the method of controlling the lifting of bottom sections of this invention is applied to a bed.
Figure 7:
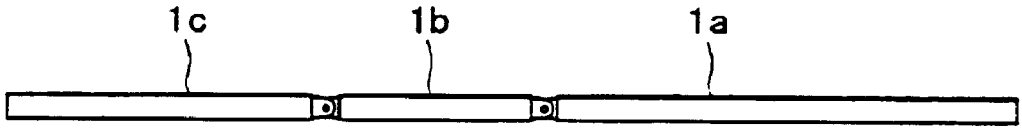
FIG. 7 is a side view showing the entire form of a bottom in a still further other phase in the lifting action, in the case where the method of controlling the lifting of bottom sections of this invention is applied to a bed.

Thus, as shown in FIG. 6, the back bottom section 1*a* is lowered to its lower limit position of lying flat, and at this time instant, the knee bottom section 1*b* stays still at a somewhat lifted position. At a time instant adequately later than this time instant, as shown in FIG. 7, all the bottom sections 1*a*, 1*b* and 1*c* reach their lower limit positions, to lie flat.

As described above, in this invention, while the back bottom section 1*a* is operated, the knee bottom section 1*b* is always adequately lifted. So, it can be prevented that the descending back bottom section 1*a* causes the lying person to slide forward. Therefore, it is not necessary that a caregiver returns the lying person caused to slide on the bed, to the original position, after all the bottom sections have been lowered to lie flat.

The control action for the back bottom section 1*a* and the knee bottom section 1*b* in this invention described above refers to a case where all the bottom sections are lowered to lie flat from a state where the back bottom section 1*a* is inclined at the largest angle after having been pivotally rotated and lifted. However, for pivotally rotating and lifting the back bottom section, to make it inclined at the largest angle from a state where all the bottom sections are kept down to lie flat, the action is reverse to the action described above. So, the action for lifting is not described here to avoid double explanation. Also in the action for lifting the back bottom section, it can be prevented that the person lying on the bottom sections slides forward.

However, as another embodiment of this invention, the respective bottom sections can also be lifted without taking the procedure reverse to that for lowering them. For example, when the back bottom section is lifted, the knee bottom section can be lowered to its lower limit position before the back bottom section reaches the highest position.

Figure 8:
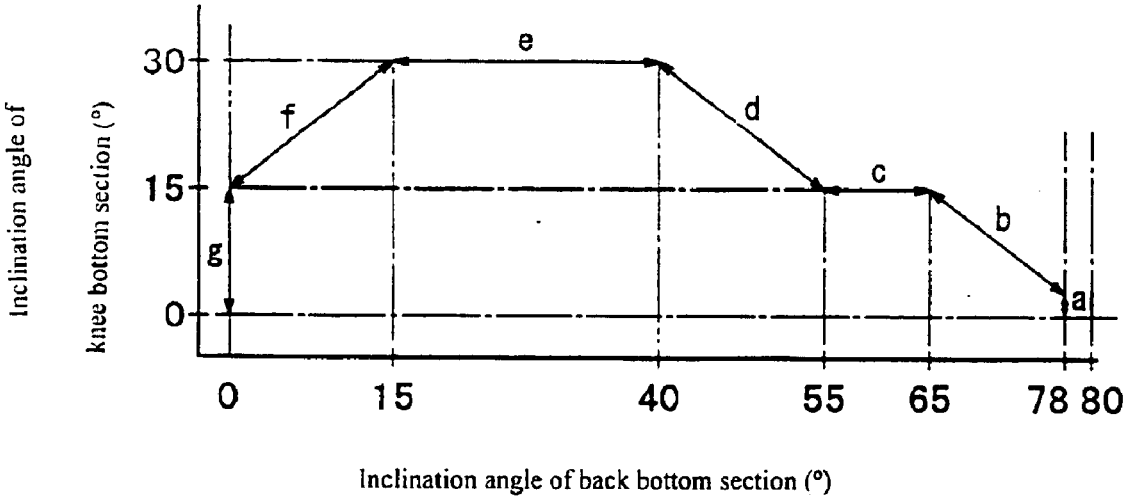
FIG. 8 is a diagram showing an example of how the inclination angles of the back bottom section and the knee bottom section change, in the case where the method of controlling the lifting of bottom sections of this invention is applied.

FIG. 8 is a diagram showing an example of how the inclination angles of the back bottom section and the knee bottom section change, in the case where the method of controlling the lifting of bottom sections of this invention is applied.

In the diagram, the inclination angle of the knee bottom section at each height position is chosen as the ordinate, and the inclination angle of the back bottom section at each height position, as the abscissa.

In FIG. 8, the respective symbols a through g shows the respective steps taken by the back bottom section 1*a* and the knee bottom section 1*b* when all the bottom sections are lowered to lie flat from a state where the back bottom section 1*a* is inclined at the largest angle after having been pivotally rotated and lifted. The respective symbols correspond to the following respective steps.

a: Since the back bottom section 1*a* is not lowered, its inclination angle is kept at 78°, and the angle of the knee bottom section 1*b* only is increased to about 3°.

b: The lowering of the back bottom section 1*a* and the lifting of the knee bottom section 1*b* occur simultaneously. The inclination angle of the back bottom section 1*a* is decreased from 78° to 65°, and at the same time, the inclination angle of the knee bottom section 1*b* is increased from 3° to 15°.

c: The lifting of the knee bottom section 1*b* is stopped, and the back bottom section 1*a* only is further lowered, making its inclination angle decreased from 65° to 55°.

d: Again the lowering of the back bottom section 1*a* and the lifting of the knee bottom section 1*b* occur simultaneously. The inclination angle of the back bottom section 1*a* is decreased from 55° to 40°, and at the same time, the inclination angle of the knee bottom section 1*b* is increased from 15° to 30°.

e: The lifting of the knee bottom section 1*b* is stopped, and the back bottom section 1*a* only is lowered, to decrease its inclination angle from 40° to 15°. The inclination angle of the knee bottom section 1*b* is kept at 30°.

f: In this step, the lowering of the back bottom section 1*a* and the lowering of the knee bottom section 1*b* occur simultaneously, to decrease the inclination angle of the back bottom section 1*a* from 15° to the lower limit position angle of 0°, and also to decrease the inclination angle of the knee bottom section 1*b* from 30° to 15°. As described here, even if the back bottom section 1*a* reaches an inclination angle of 0° at its lower limit position, the knee bottom section 1*b* is kept at an inclination angle of 15°.

g: The knee bottom section 1*b* is lowered, and its inclination angle is decreased from 15° to the lower limit position inclination angle of 0°.

As can be seen from the explanation of the above example, though the lowering and lifting of the back bottom section 1*a* are continuous, the lifting of the knee bottom section 1*b* can be intermittent.

Industrial Applicability

As described above, this invention is a method of controlling the lifting of bottom sections of lying furniture such as a bed that has a back bottom section for lifting the back portion of a lying person and a knee bottom section for lifting his/her knee portion, in which the respective bottom sections can be lifted by the lifting mechanisms respectively provided for them, characterized in that in the case where all the bottom sections are lowered to lie flat from a state where the back bottom section is kept inclined after having been pivotally rotated and lifted, at first the lifting of the knee bottom section is started, and at a time instant adequately later than the lifting start time instant, the lowering of the back bottom section is started; thereafter the lowering of the back bottom section is continued, while the knee bottom section is lifted to the preset highest position and then is lowered to reach its lower limit position of lying flat at a time instant adequately later than the time instant when the back bottom section is lowered to its lower limit position of lying flat. Therefore, it exhibits the following effects.

a. While the back bottom section is pivotally rotated and lowered, the knee bottom section stays at a lifted position. So, the lifted knee bottom section supports the position of the waist of the lying person. Therefore, even if the back bottom section is lowered in this state, it can be prevented that the lying person slides forward.

b. Therefore, when a lying person such as a patient getting up with his/her back supported by the back bottom section is lowered to lie in an ordinary state, it is not necessary that a caregiver returns the lying person caused to slide on the bed, to the original position, after all the bottom sections have been lowered to lie flat.

c. The lifting of the knee bottom section is not continued without control, but is limited to a preset high position. So, it does not happen that the angle formed between the back bottom section and the knee bottom section becomes smaller than a certain angle. Therefore, it can be prevented that the knee portion of the lying person is lifted to a position higher than necessary, or that the abdominal region is gradually bent to let him/her feel a pressure.

What is claimed is:

1. In a method of controlling raising and/or lowering of pivotally rotatable bottom sections of lying furniture having a back bottom section for raising and/or lowering a back portion of a lying person and a knee bottom section for raising and/or lowering a lying person's knee portion, and wherein said back bottom section is inclined after having been pivotally rotated and lifted, and said knee bottom section has been lowered to a flat position, the improvement comprising in the following order, the steps of:

(1) first begin raising the knee bottom section;

(2) thereafter, at a predetermined time, begin lowering the back bottom section;

(3) continue lowering the back bottom section while the knee bottom section rises to a highest position; and then (4) lowering the knee bottom section at a rate such that the knee bottom section reaches its lowest position of lying flat at a time instant later than when the back bottom section is lowered to its lower limit position of lying flat, whereby to prevent a person lying in the furniture from sliding during lowering of the back bottom section and also to prevent unpleasant pressure feeling during lowering of the back bottom section.

2. The method of claim 1, wherein the time when the lowering of the back bottom section is started later than the time when the lifting of the knee bottom section is started, and/or the time when the knee bottom section reaches the highest position is controlled in reference to the time elapsed after the time when the lifting of the knee bottom section is started to prevent body sliding and unpleasant pressure feeling of a person lying in said furniture.

3. The method of claim 2, wherein an elapsed time is preset between a time when lifting of the knee bottom section begins and lowering of the back bottom section begins.

4. The method of claim 1, wherein lowering of the back bottom section is begun in step 2 when the rising of the knee bottom section reaches a predetermined position.

5. The method of claim 1, wherein the knee bottom section in step (3) rises to a predetermined and preset highest position.

6. The method of claim 1, wherein the lying furniture is a bed.

7. The method of claim 3, wherein the lying furniture is a bed.

8. The method of claim 2, wherein an elapsed time is preset between a time when the knee bottom section reaches a highest position and a time when raising of a knee bottom section begins.

9. The method of claim 4, wherein the lying furniture is a bed.

10. The method of claim 5, wherein the lying furniture is a bed.

11. The method of claim 1, wherein lowering of the back bottom section begins in step 2 before the knee bottom section reaches a highest predetermined position, whereby to prevent a feeling of abdominal pressure for a person lying on the furniture.

12. The method of claim 1, wherein in step 3 lowering of the back bottom section and lowering of the knee bottom sections occurs simultaneously.

13. The method of claim 1, wherein while the back bottom section is pivotally rotated and lowered, the knee bottom section stays out of a lifted position so as to support the position of a waist of a person lying on said furniture.

* * * * *